US008907719B2

(12) United States Patent
Sung et al.

(10) Patent No.: US 8,907,719 B2
(45) Date of Patent: Dec. 9, 2014

(54) IC CIRCUIT

(71) Applicants: Samsung Electro-Mechanics Co., Ltd., Gyeonggi-do (KR); University of Seoul Industry Cooperation Foundation, Seoul (KR)

(72) Inventors: Joon Youp Sung, Gyeonggi-do (KR); Jae Shin Lee, Gyeonggi-do (KR); Joong Ho Choi, Gyeonggi-do (KR); Yong Seong Roh, Incheon (KR); Ho Joon Jang, Gyeonggi-do (KR); Chang Sik Yoo, Seoul (KR); Jung Sun Kwon, Gyeonggi-do (KR); Young Jin Moon, Gwangju (KR)

(73) Assignees: Samsung Electro-Mechanics Co., Ltd., Gyeonggi-Do (KR); University of Seoul Industry Cooperation Foundation, Seoul (KR)

( * ) Notice: Subject to any disclaimer, the term of this patent is extended or adjusted under 35 U.S.C. 154(b) by 0 days.

(21) Appl. No.: 13/678,491

(22) Filed: Nov. 15, 2012

(65) Prior Publication Data

US 2013/0127525 A1 May 23, 2013

(30) Foreign Application Priority Data

Nov. 17, 2011 (KR) ..... 10-2011-0120270

(51) Int. Cl.
*G05F 1/10* (2006.01)
*G05F 3/16* (2006.01)

(52) U.S. Cl.
CPC ..... *G05F 3/16* (2013.01)
USPC ..... 327/543

(58) Field of Classification Search
USPC ..... 327/530, 534–538, 540, 541, 543
See application file for complete search history.

(56) References Cited

U.S. PATENT DOCUMENTS

2008/0284501 A1* 11/2008 Kim ..... 327/538

FOREIGN PATENT DOCUMENTS

| | | |
|---|---|---|
| JP | 2008-176830 | 7/2008 |
| KR | 1019920020517 | 11/1992 |
| KR | 100239729 | 10/1999 |
| KR | 10-2009-0056893 A | 6/2009 |
| WO | WO 95/27938 | 10/1995 |

* cited by examiner

*Primary Examiner* — Sibin Chen
(74) *Attorney, Agent, or Firm* — Bracewell & Giuliani LLP; Brad Y. Chin

(57) ABSTRACT

The present invention relates to an IC circuit. In an embodiment, an IC circuit includes: an RT terminal connected to an external; a current mirroring unit conducting a channel current between internal voltage power and the RT terminal and generating an internal reference current mirrored with the channel current; a negative feedback unit receiving the internal reference current, equalizing voltages of an RT terminal connection terminal and an internal reference current output terminal of the current mirroring unit to make the internal reference current constant, and providing the internal reference current inside the IC circuit; and an IC state indicating unit having a transistor, which operates complementarily with the current mirroring unit, connected between the RT terminal and a ground and providing the state of an IC or a system to the RT terminal by being linked with the complementary operation of the current mirroring unit.

6 Claims, 3 Drawing Sheets

IC CIRCUIT

CROSS-REFERENCE TO RELATED APPLICATIONS

Claim and incorporate by reference domestic priority application and foreign priority application as follows:

CROSS REFERENCE TO RELATED APPLICATION

This application claims the benefit under 35 U.S.C. Section 119 of Korean Patent Application Serial No. 10-2011-0120270, entitled filed Nov. 17, 2011, which is hereby incorporated by reference in its entirety into this application.

BACKGROUND OF THE INVENTION

1. Field of the Invention

The present invention relates to an IC circuit, and more particularly, to an IC circuit capable of generating an internal reference current and showing the state of an IC through one RT terminal.

2. Description of the Related Art

In recent times, the most important element of various electronic devices is power efficiency. A high efficiency switching mode power supply (SMPS) is mainly used as a power supply terminal to constitute an electronic device with high power efficiency. Many ICs for implementing an SMPS are released, and ICs with integrated functions have been released to reduce manufacturing costs. The most efficient method of reducing manufacturing costs is to implement multiple functions through one pin, and the present invention relates to a technology that integrates a function of supplying an accurate reference current and a data communication function of informing the operation state of systems such as IC or SMPS.

First, a method of generating an internal reference current in a typical IC will be described. FIG. 3 shows a typical current source generator. A reference current Iref used inside an IC can be changed through a resistor 1 R1 connected to an RT pin 10. A negative feedback loop, which consists of an amplifier 14 A1, a transistor 13 M3, and the resistor 1 R1, sets a voltage of the RT pin 10 to be equal to a preset reference voltage Vref, and a current Ich of Vref/R1 flows in the external resistor 1 R1. At this time, the generated Ich current generates the internal reference voltage Iref by a current mirror consisting of transistors 11 and 12 M1 and M2. At this time, the generated Iref current varies according to a size ratio of the mirror transistors 11 and 12 M1 and M2.

Next, a method of showing an IC state in a typical IC will be described. FIG. 4 shows an example of configuration of a pin for informing the state of an IC or a system connected to the IC. FIG. 4 is implemented through a transistor 16 M4 inside the IC and a resistor 2 R2 connected between a power voltage VCC and a state information pin 15 STATE in order to inform the state of the IC or the system. If a driving signal (P of the transistor 16 M4 is high, the transistor 16 M4 is turned on so that a voltage of the state information pin 15 STATE becomes almost 0V. When the driving signal (P is low, the transistor 16 M4 is turned off so that the state information pin 15 STATE has the power voltage VCC. Accordingly, it is possible to inform the state of the IC or the system according to the voltage of the state information pin 15 STATE, and this information can be received by another block connected before or after the IC.

In the prior art, as in FIG. 3, a pin for generating an internal reference current and a pin for informing the state of an IC or a system are separately used. That is, in the prior art, an IC with two independent pins is implemented to use both of the above two functions.

SUMMARY OF THE INVENTION

The present invention has been invented in order to overcome the above-described problems and it is, therefore, an object of the present invention to provide an IC circuit capable of implementing two functions through one pin to generate an internal reference current through one pin and inform the state of an IC or a system connected to the IC through the same pin.

In accordance with a first embodiment of the present invention to achieve the object, there is provided an IC circuit including: an RT terminal connected to an external resistor or other systems; a current mirroring unit for conducting a channel current between internal voltage power and the RT terminal and generating an internal reference current which is mirrored with the channel current; a negative feedback unit for receiving the internal reference current from the current mirroring unit, equalizing a voltage of an RT terminal connection terminal and a voltage of an internal reference current output terminal of the current mirroring unit to make the internal reference current constant, and providing the internal reference current inside the IC circuit; and an IC state indicating unit comprising a transistor, which operates complementarily with the current mirroring unit according to a driving signal, connected between the RT terminal and a ground and providing the state of an IC or a system to the RT terminal by being linked with the complementary operation of the current mirroring unit, and characterized by generating the internal reference current and informing other systems of the state of the IC or the system through the RT terminal.

In another example of the present invention, the current mirroring unit may include first and second PMOS transistors of which source electrodes are connected to the internal voltage power, wherein a drain electrode of the first PMOS transistor may be connected to the RT terminal, and a drain electrode of the second PMOS transistor may provide the internal reference current to the negative feedback unit.

Further, in an example, the negative feedback unit may include an amplifier and a third PMOS transistor, wherein positive and negative input terminals of the amplifier may be connected to the RT terminal connection terminal and the internal reference current output terminal of the current mirroring unit, respectively, to maintain the RT terminal connection terminal and the internal reference current output terminal at the same voltage, and the third PMOS transistor may provide the internal reference current, which is provided from the internal reference current output terminal, inside the IC circuit while constantly maintaining the internal reference current by receiving an output of the amplifier as a gate driving signal and feeding back a source electrode to the negative input terminal of the amplifier.

At this time, in another example, the current mirroring unit may include a first PMOS transistor for conducting the channel current between the internal voltage power and the RT terminal and a second PMOS transistor for generating the internal reference current, which is mirrored with the channel current, from the internal voltage power to provide the internal reference current to the third PMOS transistor.

Further, in accordance with another example of the present invention, the IC state indicating unit may provide 0V to the RT terminal according to turn-off of the current mirroring unit during turn-on of the transistor and provide a voltage according to the internal voltage power to the RT terminal according to turn-on of the current mirroring unit during turn-off of the transistor.

In accordance with another example, the transistor of the IC state indicating unit may be an NMOS transistor.

Next, in accordance with a second embodiment of the present invention to achieve the object, there is provided an IC circuit including: an RT terminal connected to an external resistor or other systems; a current mirroring unit for conducting a channel current between internal voltage power and the RT terminal and generating an internal reference current which is mirrored with the channel current; a negative feedback unit for receiving the internal reference current from the current mirroring unit, equalizing a voltage of an RT terminal connection terminal and a voltage of an internal reference current output terminal of the current mirroring unit to make the internal reference current constant, and providing the internal reference current inside the IC circuit; and an IC state indicating unit having a transistor connected between the RT terminal and a ground, providing a mirror driving signal for operating the current mirroring unit complementarily with driving of the transistor, and showing the state of an IC or a system by whether the transistor provides a preset reference voltage to the RT terminal by being linked with the complementary operation of the current mirroring unit according to a transistor driving signal, and characterized by generating the internal reference current and informing other systems of the state of the IC or the system through the RT terminal.

In another example of the present invention, the current mirroring unit may include first and second PMOS transistors of which source electrodes are connected to the internal voltage power, wherein a drain electrode of the first PMOS transistor may be connected to the RT terminal, and a drain electrode of the second PMOS transistor may provide the internal reference current to the negative feedback unit.

Further, in accordance with an example, the current mirroring unit may further include a voltage power apply switch which is switched according to the transistor driving signal to apply the internal voltage power to gate electrodes of the first and second PMOS transistors.

In accordance with another example, the negative feedback unit may include a first amplifier and a third PMOS transistor, wherein positive and negative input terminals of the first amplifier may be connected to the RT terminal connection terminal and the internal reference current output terminal of the current mirroring unit, respectively, to maintain the RT terminal connection terminal and the internal reference current output terminal at the same voltage, and the third PMOS transistor may provide the internal reference current, which is provided from the internal reference current output terminal, inside the IC circuit while constantly maintaining the internal reference current by receiving an output of the first amplifier as a gate driving signal and by feeding back a source electrode to the negative input terminal of the first amplifier.

At this time, in another example, the current mirroring unit may include a first PMOS transistor for conducting the channel current between the internal voltage power and the RT terminal and a second PMOS transistor for generating the internal reference current, which is mirrored with the channel current, from the internal voltage power to provide the internal reference current to the third PMOS transistor.

Further, in another example of the present invention, the IC state indicating unit may include a transistor connected between the RT terminal and the ground to be driven according to the transistor driving signal; and a mirror driving signal applying unit for providing the mirror driving signal to operate the current mirroring unit complementarily with the driving of the transistor.

At this time, in another example, the mirror driving signal applying unit may include a second amplifier having a negative input terminal to which the preset reference voltage is applied and a positive input terminal fed back from the RT terminal connection terminal; an inverter for inverting the transistor driving signal to output the inverted signal; and an invert output switch switched according to an output signal of the inverter to apply an output signal of the second amplifier as a driving signal of the current mirroring unit.

Moreover, at this time, in another example, the IC state indicating unit may provide 0V to the RT terminal according to turn-off of the current mirroring unit during turn-on of the transistor and provide the preset reference voltage to the RT terminal according to the feedback to the second amplifier according to turn-on of the current mirroring unit during turn-off of the transistor.

Further, in accordance with an example, the transistor of the IC state indicating unit may be an NMOS transistor.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERABLE EMBODIMENTS

Figure 1:
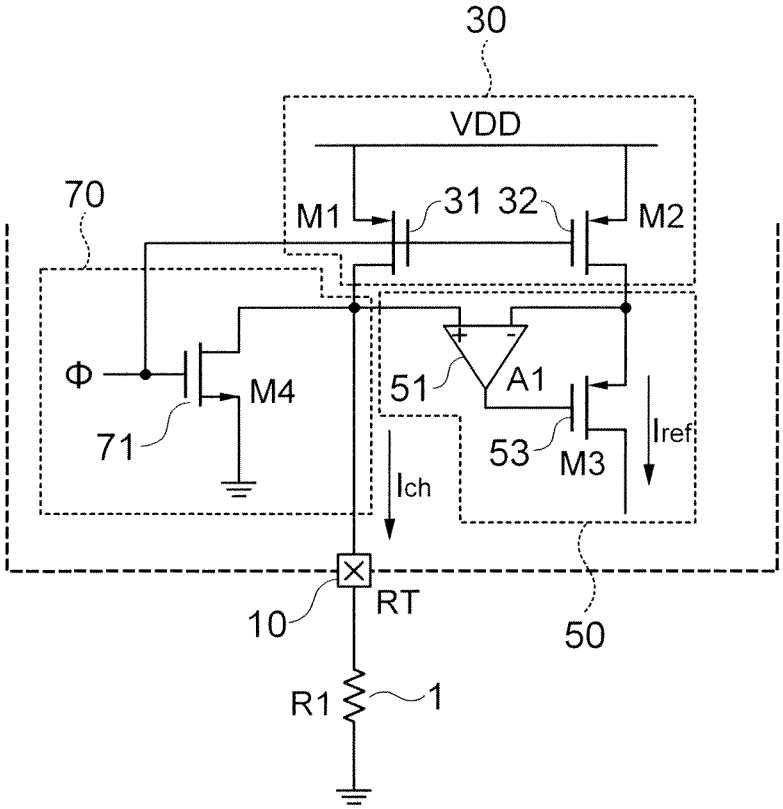
FIG. 1 is a schematic circuit diagram of an IC circuit in accordance with a first embodiment of the present invention.

Embodiments of the present invention to achieve the above-described objects will be described with reference to the accompanying drawings. In this description, the same elements are represented by the same reference numerals, and additional description which is repeated or limits interpretation of the meaning of the invention may be omitted.

In this specification, when an element is referred to as being "connected or coupled to" or "disposed in" another element, it can be "directly" connected or coupled to or "directly" disposed in the other element or connected or coupled to or disposed in the other element with another element interposed therebetween, unless it is referred to as being "directly coupled or connected to" or "directly disposed in" the other element. Further, it should be understood that when an element is referred to as being "on", "above", "under", or "below" another element, it can be "directly" in contact with the other element or in contact with the other element with another element interposed therebetween, unless it is referred to as being directly in contact with the other element. When the direction of the reference element is reversed or changed, it can be used as the meaning including the concept depending on the direction of the corresponding relative terms.

Although the singular form is used in this specification, it should be noted that the singular form can be used as the concept representing the plural form unless being contradictory to the concept of the invention or clearly interpreted otherwise. It should be understood that the terms such as "having", "including", and "comprising" used herein do not preclude existence or addition of one or more other elements or combination thereof.

First, an IC circuit in accordance with a first embodiment of the present invention will be described in detail with reference to the drawings. FIG. 1 is a schematic diagram of the IC circuit in accordance with the first embodiment.

Referring to FIG. 1, the IC circuit in accordance with the first embodiment includes an RT terminal 10, a current mirroring unit 30, a negative feedback unit 50, and an IC state indicating unit 70. At this time, the IC circuit in accordance with this embodiment generates an internal reference current Iref and informs other systems of the state of an IC or a system through one RT terminal 10.

First, referring to FIG. 1, the RT terminal 10 in this embodiment is a terminal connected to an external resistor 1 or other systems. At this time, it is possible to generate the internal reference current Iref and inform other systems of the state of the IC or the system through one RT terminal 10.

Continuously, referring to FIG. 1, the current mirroring unit 30 is disposed between internal voltage power VDD and the RT terminal 10 and conducts a channel current Ich, which is a reference of a mirroring current, from the internal voltage power VDD to the RT terminal 10. At this time, the current mirroring unit 30 generates the internal reference current Iref, which is mirrored with the channel current, and provides the internal reference current Iref through another output terminal, which is not connected to the RT terminal, that is, an internal reference current output terminal. At this time, a mirroring ratio of the channel current Ich and the internal reference current Iref may be determined by a size ratio of mirroring transistors.

For example, for current mirroring, it is possible to equalize gate voltages of the both mirror transistors, which correspond to each other, and gate-source voltages or source-gate voltages, which affect a size of a mirrored drain or source current.

At this time, in an example, the current mirroring unit 30 may include first and second PMOS transistors 31 and 32 of which source electrodes are connected to the internal voltage power VDD. A drain electrode of the first PMOS transistor 31 is connected to the RT terminal 10, and a drain electrode of the second PMOS transistor 32 can provide the internal reference current Iref to the negative feedback unit 50. At this time, the source electrodes of the first and second PMOS transistors 31 and 32 are connected to the internal voltage power VDD.

At this time, the mirroring ratio of the channel current Ich and the internal reference current Iref may be determined by a size ratio of the first PMOS transistor 31 and the second PMOS transistor 32.

In an example, referring to FIG. 1, an RT terminal connection terminal and the internal reference current output terminal, which are the drain electrodes of the first and second PMOS transistors 31 and 32, are connected to non-inverting and inverting input terminals of an amplifier 51 of the negative feedback unit 50, respectively, and can maintain the same voltage. At this time, the internal reference current Iref, which is mirrored with the channel current Ich through the internal reference current output terminal as the drain electrode of the second PMOS transistor 32, can be provided inside the IC circuit through a third PMOS transistor 53 of the negative feedback unit 50.

Continuously, referring to FIG. 1, the negative feedback unit 50 will be described.

The negative feedback unit 50 receives the internal reference current Iref from the current mirroring unit 30. At this time, the negative feedback unit 50 equalizes a voltage of the RT terminal connection terminal and a voltage of the internal reference current output terminal of the current mirroring unit 30 to make the internal reference current Iref constant. The negative feedback unit 50 provides the internal reference current Iref inside the IC circuit.

Referring to FIG. 1, it is possible to make the internal reference current Iref, which is generated from the current mirroring unit 30, constant by equally maintaining the voltage of the RT terminal connection terminal and the voltage of the internal reference current output terminal of the current mirroring unit 30 by the negative feedback unit 50.

Further, in an example, referring to FIG. 1, the negative feedback unit 50 includes the amplifier 51 and the third PMOS transistor 53. At this time, positive and negative input terminals of the amplifier 51 are connected to the RT terminal connection terminal and the internal reference current output terminal of the current mirroring unit 30, respectively, to maintain the RT terminal connection terminal and the internal reference current output terminal at the same voltage.

Referring to FIG. 1, the third PMOS transistor 53 of the negative feedback unit 50 receives an output of the amplifier 51 as a gate driving signal. And a source electrode of the third PMOS transistor 53 is fed back to the negative input terminal of the amplifier 51. Accordingly, the third PMOS transistor 53 can constantly maintain the internal reference current Iref provided from the internal reference current output terminal of the current mirroring unit 30 and provide the internal reference current Iref, which is constantly maintained without being affected by a voltage of an internal system connected to a drain electrode, inside the IC circuit through the drain electrode. That is, in FIG. 1, a negative feedback system, which consists of the amplifier 51 A1, the first PMOS transistor 31 M1, the second PMOS transistor 32 M2, and the third PMOS transistor 53 M3, equalizes voltages of drain nodes of the first PMOS transistor 31 M1 and the second PMOS transistor 32 M2. Finally, since voltages of drain/gate/source or drain/gate/source/body of the first PMOS transistor 31 M1 and the second PMOS transistor 32 M2 are all the same, the ratio of the channel current Ich and the mirror current Iref becomes equal to the size ratio of the first PMOS transistor 31 M1 and the second PMOS transistor 32 M2 by current mirroring.

At this time, referring to FIG. 1, in an example, the source electrode of the third PMOS transistor 53 is connected to the drain electrode of the second PMOS transistor 32 of the current mirroring unit 30, that is, the internal reference current output terminal. Accordingly, the internal reference current Iref, that is, the mirror current flowing through the mirrored second PMOS transistor 32 can be provided inside the IC circuit through the third PMOS transistor 53.

Next, the IC state indicating unit 70 will be described with reference to FIG. 1. The IC state indicating unit 70 includes a transistor 71 connected between the RT terminal 10 and a ground. The IC state indicating unit 70 provides a driving signal for operating the current mirroring unit 70 complementarily with driving of the transistor 71 of the IC state indicating unit 70. In the IC state indicating unit 70, the transistor 71 operates complementarily with the current mirroring unit 30 according to the driving signal. At this time, the operation of the transistor 71 is interlocked with the complementary operation of the current mirroring unit 30, and the IC state indicating unit 70 provides the RT terminal 10 with the state of the IC or the system.

Further, in accordance with an example, the current mirroring unit 30 is turned off according to the signal provided from the IC state indicating unit 70 during turn-on of the transistor 71 of the IC state indicating unit 70. Accordingly, the IC state indicating unit 70 allows 0V to be provided to the RT terminal 10 according to the turn-off of the current mirroring unit 30 and the turn-on of the transistor 71. Further, the IC state indicating unit 70 allows a voltage according to the internal voltage power to be provided to the RT terminal 10 according to the turn-on of the current mirroring unit 30 during the turn-off of the transistor 71. At this time, the voltage according to the internal voltage power provided to the RT terminal 10 has substantially almost the same value as the internal voltage power. Accordingly, it is possible to know the state of the IC or the system through the voltage applied to the RT terminal 10 by the operation of the IC state indicating unit 70.

Further, referring to FIG. 1, in an example, the transistor of the IC state indicating unit 70 may be an NMOS transistor 71. At this time, when a signal for driving the NMOS transistor 71 of the IC state indicating unit 70 is input, the IC state indicating unit 70 applies the same signal to the current mirroring unit 30 to complementarily operate the current mirroring unit 30.

Referring to FIG. 1, at this time, since the current mirroring unit 30 consists of the first and second PMOS transistors 31 and 32, when the same signal as the signal for driving the NMOS transistor 71 of the IC state indicating unit 70 is applied to the gate electrodes of the first and second PMOS transistors 31 and 32, the first and second PMOS transistors 31 and 32 are turned off, on the other hand, the NMOS transistor 71 is turned on so that substantially 0V, that is, a ground voltage, is applied to the RT terminal 10. That is, in FIG. 1, when the NMOS transistor driving signal ϕ is high, the NMOS transistor 71 M4 is turned on and the first PMOS transistor 31 M1 and the second PMOS transistor 32 M2, which form the current mirroring unit 30, are turned off. Therefore, since the voltage of the RT pin 10 becomes substantially 0V and the channel current Ich is substantially 0, the mirrored internal reference current Iref also becomes 0.

On the contrary, when an off driving signal is applied to the NMOS transistor 71, the first and second PMOS transistors 31 and 32 are turned on and the channel current Ich flows from the internal voltage power to the RT terminal 10. On the other hand, since the NMOS transistor 71 is in off state, a voltage, which is substantially almost the same as the internal voltage power, is applied to the RT terminal 10. In FIG. 1, when the NMOS transistor driving signal ϕ is low, the NMOS transistor 71 M4 is turned off and the first PMOS transistor 31 M1 and the second PMOS transistor 32 M2, which form the current mirroring unit 30, are turned on. At this time, since the first PMOS transistor 31 M1 and the second PMOS transistor 32 M2 operate in a linear region, the voltage of the RT terminal 10 has almost the same value as the internal voltage power VDD and the channel current Ich, which flows through the external resistor R1 connected to the RT terminal 10, is the same as VDD/R1.

It is possible to know the state of the IC or the system by whether the voltage applied to the RT terminal 10 is substantially 0V or almost the same value as the internal voltage power VDD. That is, when the voltage applied to the RT terminal 10 is substantially equal or almost similar to VDD, the first and second PMOS transistors 31 and 32 are driven, on the other hand, the NMOS transistor 71 is turned off, that is, the IC or the system is in on state. When the voltage applied to the RT terminal 10 is substantially almost 0V, that is, the ground voltage, the NMOS transistor 71 is driven, on the other hand, the first and second PMOS transistors 31 and 32 are turned off, that is, the IC or the system is in off state. For example, the NMOS transistor driving signal ϕ may be an inverted signal of the driving signal provided in a state in which the IC is turned on. At this time, when the IC is turned off, the NMOS transistor driving signal ϕ is applied as high so that the NMOS transistor 71 is driven, the first and second PMOS transistors 31 and 32 are turned off, and the voltage applied to the RT terminal 10 is substantially the ground voltage or almost 0V. In other words, when the driving signal ϕ is high, the RT terminal 10 has substantially 0V and Iref is 0. When the driving signal ϕ is low, since the RT terminal 10 has substantially the same value as the VDD value and the channel current has a value of Ich=VDD/R1, it is possible to transmit the state of the IC or the system including the IC to other systems and generate the internal reference current Iref through the voltage of the RT pin 10 according to the driving signal.

Figure 2:
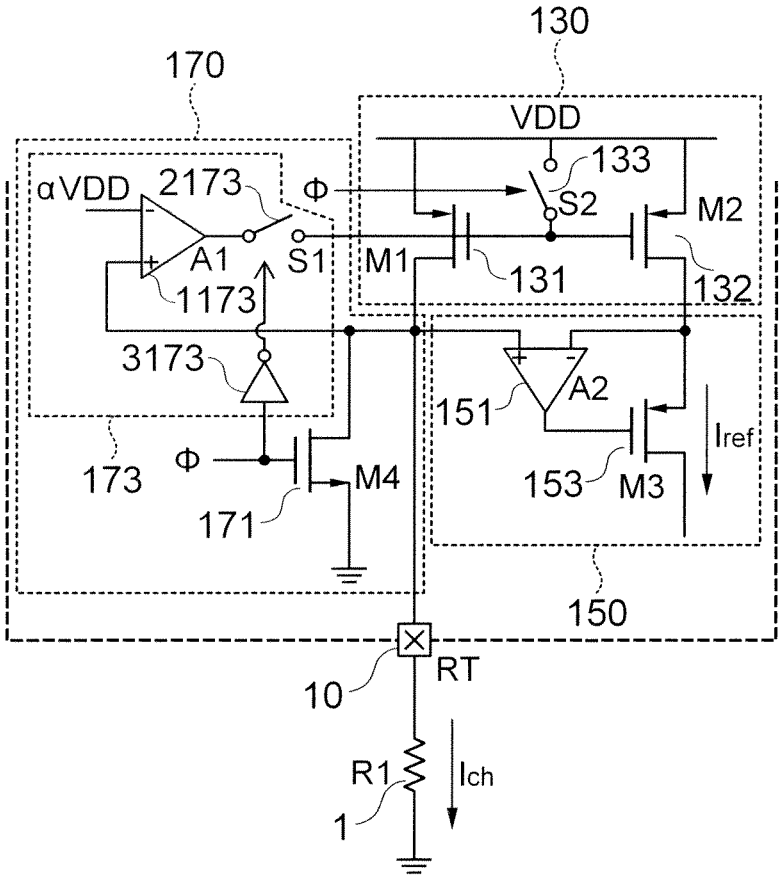
FIG. 2 is a schematic circuit diagram of an IC circuit in accordance with a second embodiment of the present invention.
Figure 3:
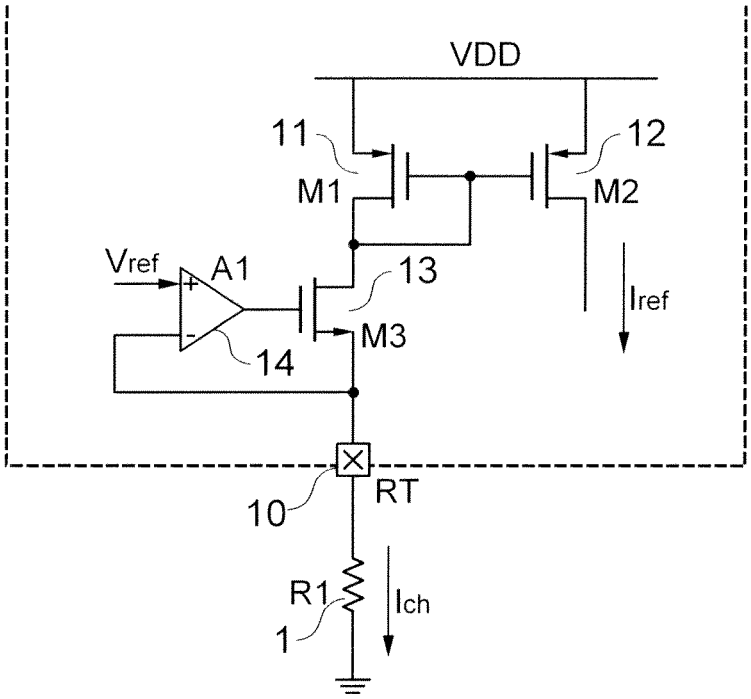
FIG. 3 is a circuit diagram schematically showing a reference voltage generating circuit of a typical IC circuit.
Figure 4:
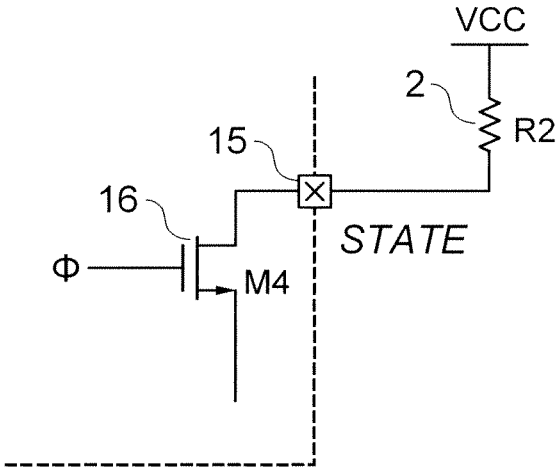
FIG. 4 is a circuit diagram schematically showing an IC state indicating circuit of the typical IC circuit.

Next, an IC circuit in accordance with a second embodiment of the present invention will be described in detail with reference to the drawings. FIG. 2 is a schematic circuit diagram of the IC circuit in accordance with the second embodiment of the present invention.

Referring to FIG. 2, like the first embodiment, the IC circuit in accordance with the second embodiment of the present invention includes an RT terminal 10, a current mirroring unit 130, a negative feedback unit 150, and an IC state indicating unit 170. At this time, the IC circuit in accordance with this embodiment generates an internal reference current Iref and informs the state of an IC or a system to other systems through one RT terminal 10.

First, the RT terminal 10 is a terminal connected to an external resistor 1 R1 or other systems. At this time, it is possible to generate the internal reference current Iref and inform other systems of the state of the IC or the system through one RT terminal 10.

When describing the current mirroring unit 130 with reference to FIG. 2, the current mirroring unit 130 is disposed between internal voltage power VDD and the RT terminal 10 and conducts a channel current Ich, which is a reference of a mirroring current, from the internal voltage power VDD to the RT terminal 10. At this time, the current mirroring unit 130 generates the internal reference current Iref, which is mirrored with the channel current Ich, and provides the internal reference current Iref through another output terminal, which is not connected to the RT terminal 10, that is, an internal reference current output terminal. At this time, a mirroring ratio of the channel current Ich and the internal reference current Iref may be determined by a size ratio of mirroring transistors.

At this time, referring to FIG. 2, in an example, the current mirroring unit 130 may include first and second PMOS transistors 131 and 132 of which source electrodes are connected to the internal voltage power VDD. A drain electrode of the first PMOS transistor 131 is connected to the RT terminal 10, and a drain electrode of the second PMOS transistor 132 can provide the internal reference current Iref to the negative feedback unit 150. At this time, the source electrodes of the first and second PMOS transistors 131 and 132 may be connected to the internal voltage power VDD. At this time, the mirroring ratio of the channel current Ich and the internal reference current Iref may be determined by a size ratio of the first PMOS transistor 131 and the second PMOS transistor 132.

In an example, referring to FIG. 2, an RT terminal connection terminal and the internal reference current output terminal, which are the drain electrodes of the first and second PMOS transistors 131 and 132, are connected to non-inverting and inverting input terminals of an amplifier 151 of the negative feedback unit 150, respectively, and can maintain the same voltage. At this time, the internal reference current Iref, which is mirrored with the channel current Ich through the internal reference current output terminal as the drain electrode of the second PMOS transistor 132, can be provided inside the IC circuit through a third PMOS transistor 153 of the negative feedback unit 150.

Further, when describing another example with reference to FIG. 2, the current mirroring unit 130 may further include a voltage power apply switch 133 which is switched according to a transistor driving signal ϕ of the following IC state indicating unit 170 to apply the internal voltage power to gate electrodes of the first and second PMOS transistors 131 and 132. At this time, the voltage power apply switch 133 allows the first and second PMOS transistors 131 and 132 to operate complementarily with driving of, for example, an NMOS transistor 171 of the IC state indicating unit 170. Therefore, the IC state indicating unit 170 can indicate the state of an IC or a system through the RT terminal 10.

Continuously, the negative feedback unit 150 will be described with reference to FIG. 2. Referring to FIG. 2, the negative feedback unit 150 receives the internal reference current Iref from the current mirroring unit 130. At this time, the negative feedback unit 150 equalizes a voltage of the RT terminal connection terminal and a voltage of the internal reference current output terminal of the current mirroring unit 130 to make the internal reference current Iref constant. The negative feedback unit 150 provides the internal reference current Iref inside the IC circuit. Referring to FIG. 2, it is possible to make the internal reference current Iref, which is generated from the current mirroring unit 130, constant by equally maintaining the voltage of the RT terminal connection terminal and the voltage of the internal reference current output terminal of the current mirroring unit 130 by the negative feedback unit 150.

Further, referring to FIG. 2, in another example, the negative feedback unit 150 may include the amplifier 151 and the third PMOS transistor 153. At this time, positive and negative input terminals of the amplifier 151 are connected to the RT terminal connection terminal and the internal reference current output terminal of the current mirroring unit 130, respectively, to maintain the RT terminal connection terminal and the internal reference current output terminal at the same voltage.

Continuously, in FIG. 2, the third PMOS transistor 153 of the negative feedback unit 150 receives an output of the amplifier 151 as a gate driving signal. In FIG. 2, a source electrode of the third PMOS transistor 153 is fed back to the negative input terminal of the amplifier 151. Accordingly, the third PMOS transistor 153 can constantly maintain the internal reference current Iref provided from the internal reference current output terminal of the current mirroring unit 130 and provide the internal reference current Iref, which is constantly maintained without being affected by a voltage of an internal system connected to a drain electrode, inside the IC circuit through the drain electrode.

At this time, referring to FIG. 2, in an example, the source electrode of the third PMOS transistor 153 is connected to the drain electrode of the second PMOS transistor 132 of the current mirroring unit 130, that is, the internal reference current output terminal. Accordingly, the internal reference current Iref, that is, the mirror current flowing through the mirrored second PMOS transistor 132 can be provided inside the IC circuit through the third PMOS transistor 153.

In FIG. 2, a negative feedback system, which consists of the amplifier 151 A2, the first PMOS transistor 131 M1, the second PMOS transistor 132 M2, and the third PMOS transistor 153 M3, equalizes voltages of drain nodes of the first PMOS transistor 131 M1 and the second PMOS transistor 132 M2. Finally, since voltages of drain/gate/source or drain/gate/source/body of the first PMOS transistor 131 M1 and the second PMOS transistor 132 M2 are all the same, the ratio of the channel current Ich and the mirror current Iref becomes equal to the size ratio of the first PMOS transistor 131 M1 and the second PMOS transistor 132 M2 by current mirroring.

Continuously, the IC state indicating unit 170 will be described with reference to FIG. 2. In FIG. 2, the IC state indicating unit 170 includes a transistor 171 connected between the RT terminal 10 and a ground. The IC state indicating unit 170 provides a mirror driving signal for operating the current mirroring unit 130 complementarily with driving of the transistor 171 of the IC state indicating unit 170. At this time, the mirror driving signal may be a signal which is complementary with the transistor driving signal ϕ for driving the transistor 171. The transistor 71, which is driven according to the transistor driving signal ϕ, operates complementarily with operation of the current mirroring unit 130. At this time, the IC state indicating unit 170 provides the RT terminal 10 with the state of the IC or the system by interlocking the operation of the transistor 171 according to the transistor driving signal ϕ with the complementary operation of the current mirroring unit 130.

Further, referring to FIG. 2, in another example of the present invention, the IC state indicating unit 170 may include the transistor 171 connected between the RT terminal 10 and the ground and a mirror driving signal applying unit 173 for providing the mirror driving signal. The transistor 171 is driven according to the transistor driving signal CD. At this time, the mirror driving signal applying unit 173 provides the mirror driving signal as a signal which is complementary with the transistor driving signal ϕ for driving the transistor 171 to the current mirroring unit 130 so as to operate the current mirroring unit 130 complementarily with the driving of the transistor 171.

FIG. 2 will be described in more detail. Referring to FIG. 2, in another example, the mirror driving signal applying unit 173 may include a second amplifier 1173, an inverter 3173, and an invert output switch 2173.

At this time, in FIG. 2, a preset reference voltage is applied to a negative input terminal of the second amplifier 1173. At this time, the preset reference voltage aVDD may be a voltage lower than the internal voltage power VDD. Further, a positive input terminal of the second amplifier 1173 is fed back from the RT terminal connection terminal of the current mirroring unit 130 and connected to the RT terminal 10. In this embodiment, the IC state indicating unit 170 allows the preset reference voltage input to the negative input terminal of the second amplifier 1173 to be equally applied to the positive input terminal of the second amplifier 1173 and to be shown through the feedback-connected RT terminal 10 so as to inform the state of the IC or the system.

Further, the inverter 3173 and the invert output switch 2173 of FIG. 2 will be described. The inverter 3173 inverts the transistor driving signal to output the inverted signal. At this time, the invert output switch 2173 is switched according to an output signal of the inverter 3173. The invert output switch 2173 can apply the output signal of the second amplifier 1173 as a current mirroring unit driving signal by switching operation according to the output signal of the inverter 2173. The mirror driving signal is applied to the current mirroring unit 130 from the second amplifier 1173 according to the operation of the invert output switch 2173 so that the current mirroring unit 130 can conduct the channel current Ich between the internal voltage power and the RT terminal 10 and generate the internal reference current Iref mirrored with the channel current Ich.

At this time, referring to FIG. 2, the IC state indicating unit 170 provides the mirror driving signal, which operates complementarily with the transistor driving signal ϕ during turn-on of the transistor, to the current mirroring unit 130 to turn off the current mirroring unit 130. Accordingly, the IC state indicating unit 170 allows a substantial ground voltage or 0V to be provided to the RT terminal 10 according to the turn-off of the current mirroring unit 130 and the turn-on of the transistor. Further, the IC state indicating unit 170 allows the preset reference voltage to be provided to the RT terminal 10 according to the turn-on of the current mirroring unit 130 during the turn-off the transistor. Referring to FIG. 2, when the transistor driving signal ϕ is in low state, that is, the transistor is turned off, the output of the second amplifier 1173 is applied to the current mirroring unit 130 as the mirror driving signal according to the operation of the invert output switch 2173 so that the current mirroring unit 130 is turned on. At this time, since the RT terminal connection terminal of the current mirroring unit 130 is feedback-connected to the positive terminal of the second amplifier 1173, the preset reference voltage aVDD, which is applied to the negative terminal of the second amplifier 1173, can be provided to the RT terminal 10. Accordingly, by the operation of the IC state indicating unit 170, it is possible to know the state of the IC or the system through the voltage applied to the RT terminal 10.

Further, referring to FIG. 2, in an example, the transistor of the IC state indicating unit 170 may be an NMOS transistor 171. At this time, when a signal for driving the NMOS transistor 171 of the IC state indicating unit 170 is input, the IC state indicating unit 170 applies the mirror driving signal, a complementary signal, to the current mirroring unit 130 to complementarily operate the current mirroring unit 130. Referring to FIG. 2, at this time, since the current mirroring unit 130 consists of the first and second PMOS transistors 131 and 132, the mirror driving signal, which is complementary with the signal for driving the NMOS transistor 171 of the IC state indicating unit 170, is applied to the gate electrodes of the first and second PMOS transistors 131 and 132, the first and second PMOS transistors 131 and 132 are turned off, on the other hand, the NMOS transistor 171 is turned on, and the ground voltage, substantially 0V, is applied to the RT terminal 10. In more detail, when the transistor driving signal ϕ is applied to the NMOS transistor 171, an inverted signal of the transistor driving signal ϕ, which is inverted by the inverter 3173, is applied to the invert output switch 2173 to turn off the invert output switch 2173. Accordingly, the first and second PMOS transistors 131 and 132 are turned off. On the contrary, when a low signal or an off signal is applied to the NMOS transistor 171 as the transistor driving signal ϕ, the signal is inverted by the inverter 3173 so that the invert output switch 2173 is turned on, and the output signal of the second amplifier 1173 is applied to the first and second PMOS transistors 131 and 132 as the mirror driving signal according to the turn-on of the invert output switch 2173 so that the first and second PMOS transistors 131 and 132 are turned on. At this time, since the RT terminal connection terminal of the first PMOS transistor 131 is fed back to the positive terminal of the second amplifier 173 and the NMOS transistor 171 is in off state, the preset reference voltage aVDD of the negative terminal of the second amplifier 1173 can be provided to the RT terminal 10 through feedback-connection.

When describing again with reference to FIG. 2, when the transistor driving signal ϕ is high, the NMOS transistor 171 M4 and the voltage power apply switch 133 S2 are turned on and the invert output switch 2173 S1 is turned off. Accordingly, since the voltage of the RT terminal 10 becomes substantially 0V and the channel current Ich is substantially 0, the internal reference current Iref, the mirrored current, also becomes substantially 0. On the contrary, when the transistor driving signal ϕ is low, the NMOS transistor 171 M4 and the voltage power apply switch 133 S2 are turned off and the invert output switch 2173 S1 is turned on. At this time, by a negative feedback system, which consists of the second amplifier 1173 A1, the first PMOS transistor M1, and the RT terminal 10, the voltage of the RT terminal 10 has substantially a value of aVDD, and the channel current Ich flowing through the external resistor R1 is substantially the same as the value of aVDD.

At this time, it is possible to know the state of the IC or the system by whether the preset reference voltage aVDD or substantially 0V is applied to the RT terminal 10. That is, when the voltage applied to the RT terminal 10 is substantially equal or almost similar to the preset reference voltage aVDD, the first and second PMOS transistors 131 and 132 are driven, on the other hand, the NMOS transistor 171 is turned off, that is, the IC or the system is in on state. When the voltage applied to the RT terminal 10 is substantially the ground voltage, that is, almost 0V, the NMOS transistor 171 is driven, on the other hand, the first and second PMOS transistors 131 and 132 are turned off, that is, the IC or the system is turned off. In other words, when the driving signal ϕ is high, the RT terminal 10 has substantially 0V and Iref is 0. When the driving signal ϕ is low, the RT terminal 10 has substantially the same value as aVDD and the channel current has a value of Ich=aVDD/R1. Therefore, it is possible to transmit the state of the IC or the system including the IC to other systems and generate the internal reference current Iref through the voltage of the RT pin 10 according to the driving signal O.

In the first and second embodiments of the present invention, it is possible to generate the internal reference current and inform the state of the IC or the system connected to the IC through one RT pin 10. Therefore, it is possible to implement two functions through one terminal and thus reduce manufacturing costs.

In accordance with embodiments of the present invention, it is possible to generate an internal reference current through one pin and inform the state of an IC or a system connected to the IC through the same pin.

That is, in embodiments of the present invention, it is possible to implement two functions such as generation of the internal reference current and display of information on the state of the IC or the system through one RT pin. Accordingly, it is possible to reduce manufacturing costs of the IC.

It is apparent that various effects which have not been directly mentioned according to the various embodiments of the present invention can be derived by those skilled in the art from various constructions according to the embodiments of the present invention.

The above-described embodiments and the accompanying drawings are provided as examples to help understanding of those skilled in the art, not limiting the scope of the present invention. Further, embodiments according to various combinations of the above-described components will be apparently implemented from the foregoing specific descriptions by those skilled in the art. Therefore, the various embodiments of the present invention may be embodied in different forms in a range without departing from the essential concept of the present invention, and the scope of the present invention should be interpreted from the invention defined in the claims. It is to be understood that the present invention includes various modifications, substitutions, and equivalents by those skilled in the art.

What is claimed is:

1. An IC circuit comprising:

an RT terminal connected to an external resistor or other systems;

a current mirroring unit for conducting a channel current between internal voltage power and the RT terminal and generating an internal reference current which is mirrored with the channel current;

a negative feedback unit for receiving the internal reference current from the current mirroring unit, equalizing a voltage of an RT terminal connection terminal and a voltage of an internal reference current output terminal of the current mirroring unit to make the internal reference current constant, and providing the internal reference current inside the IC circuit; and an IC state indicating unit comprising a transistor, which operates complementarily with the current mirroring unit according to a driving signal, connected between the RT terminal and a ground and providing the state of an IC or a system to the RT terminal by being linked with the complementary operation of the current mirroring unit, and characterized by generating the internal reference current and informing other systems of the state of the IC or the system through the RT terminal, wherein the negative feedback unit comprises an amplifier and a third PMOS transistor, wherein positive and negative input terminals of the amplifier are connected to the RT terminal connection terminal and the internal reference current output terminal of the current mirroring unit, respectively, to maintain the RT terminal connection terminal and the internal reference current output terminal at the same voltage, and wherein the third PMOS transistor provides the internal reference current, which is provided from the internal reference current output terminal, inside the IC circuit, while constantly maintaining the internal reference current by receiving an output of the amplifier as a gate driving signal and by feeding back a source electrode to the negative input terminal of the amplifier.

2. The IC circuit according to claim 1, wherein the current mirroring unit comprises first and second PMOS transistors of which source electrodes are connected to the internal voltage power, wherein a drain electrode of the first PMOS transistor is connected to the RT terminal, and a drain electrode of the second PMOS transistor provides the internal reference current to the negative feedback unit.

3. The IC circuit according to claim 1, wherein the current mirroring unit comprises a first PMOS transistor for conducting the channel current between the internal voltage power and the RT terminal and a second PMOS transistor for generating the internal reference current, which is mirrored with the channel current, from the internal voltage power to provide the internal reference current to the third PMOS transistor.

4. The IC circuit according to claim 1, wherein the IC state indicating unit provides 0V to the RT terminal according to turn-off of the current mirroring unit during turn-on of the transistor and provides a voltage according to the internal voltage power to the RT terminal according to turn-on of the current mirroring unit during turn-off of the transistor.

5. The IC circuit according to claim 1, wherein the transistor of the IC slate indicating unit is an NMOS transistor.

6. The IC circuit according to claim 2, wherein the transistor of the IC state indicating unit is an NMOS transistor.

* * * * *